US007520657B2

(12) United States Patent
Andrews et al.

(10) Patent No.: US 7,520,657 B2
(45) Date of Patent: Apr. 21, 2009

(54) MAGNETIC STIRRER

(75) Inventors: Bryan C. Andrews, Chilton, WI (US); Darryl B. Detwiler, Sheboygan, WI (US)

(73) Assignee: Sigma-Aldrich Co., St. Louis, MO (US)

( * ) Notice: Subject to any disclaimer, the term of this patent is extended or adjusted under 35 U.S.C. 154(b) by 0 days.

(21) Appl. No.: 11/777,592

(22) Filed: Jul. 13, 2007

(65) Prior Publication Data

US 2008/0013400 A1 Jan. 17, 2008

Related U.S. Application Data

(60) Provisional application No. 60/807,452, filed on Jul. 14, 2006.

(51) Int. Cl.
*B01F 13/08* (2006.01)

(52) U.S. Cl. ..... 366/144; 366/273

(58) Field of Classification Search ..... 366/273, 366/274, 144

See application file for complete search history.

(56) References Cited

U.S. PATENT DOCUMENTS 2,810,556 A * 10/1957 Zozulin ..... 366/274
3,384,353 A * 5/1968 Worth ..... 366/274
3,744,764 A 7/1973 Sedam
4,752,138 A * 6/1988 Rufer ..... 366/274
4,756,625 A 7/1988 Schultz
5,261,742 A 11/1993 Lockhart
5,478,149 A * 12/1995 Quigg ..... 366/273
5,586,823 A * 12/1996 Carr ..... 366/274
5,834,739 A * 11/1998 Lockwood et al. ..... 219/468.1
6,585,405 B2 * 7/2003 Bruno et al. ..... 366/266
6,758,593 B1 * 7/2004 Terentiev ..... 366/273
6,793,167 B2 * 9/2004 Karkos et al. ..... 241/101.2
2005/0023016 A1 * 2/2005 Nakamizo ..... 173/93.5
2006/0221765 A1 * 10/2006 Andersson ..... 366/273
2007/0036027 A1 * 2/2007 Meier ..... 366/273

* cited by examiner

*Primary Examiner*—Tony G Soohoo
(74) *Attorney, Agent, or Firm*—Senniger Powers LLP; Jill Rogers-Manning

(57) ABSTRACT

A magnetic stirring system includes a stir-mantle and a magnetic stirring apparatus used for stirring/mixing materials in a flask. A rare-earth magnet is mounted on the magnetic stirring apparatus and is driven in rotation by a pneumatic motor. The rare-earth magnet is coupled to a magnetic stir bar in the flask for conjoint rotation so that the stir-bar stirs/mixes the materials in the flask. An exhaust is included to channel air from the motor to the rare-earth magnet and to direct the air to flow over the magnet to control the temperature of the magnet.

18 Claims, 10 Drawing Sheets

MAGNETIC STIRRER

RELATED APPLICATIONS

This application is a non-provisional application of U.S. Ser. No. 60/807,452, filed Jul. 14, 2007.

FIELD OF THE INVENTION

The present invention relates generally to stirrers, and more particularly to a magnetic stirrer for mixing material within a vessel.

BACKGROUND OF THE INVENTION

Many chemical reactions and physical reactions (e. g., distillations) are facilitated by stirring/mixing the materials within a vessel. One way to do this is to stir the materials in a vessel with a mechanical stirrer. For example, a motor-driven rotatable spindle may be used in which one or more stirring members (e.g., blades) of the spindle can be positioned in the vessel to stir the materials.

As another example, a motor-driven magnetic stirrer may be used. In this stirrer, a magnetic stir bar is positioned within the vessel and a base magnet magnetically coupled to the stir bar is positioned under the vessel near the stir bar. A motor is used to rotate the base magnet, which in turn rotates the stir bar in the vessel to stir the materials. A magnetic stirrer is often desirable because minimal stirring structure is introduced into the vessel, reducing concerns of contamination or leakage to/from the vessel. In addition, small stir bars can be used which are easier to insert into vessels having small inlet openings such as round-bottom flasks (small inlet openings help prevent release of undesirable materials into the environment or vice versa).

However, strong base magnets are required with these magnetic stirrers, particularly when driving the stir bars in viscous materials or large volumes of materials (e.g., 20, 50 or 70 liters of materials). Traditional base magnets are often not strong enough to handle these conditions. In many cases, the coupling force between a traditional base magnet and the stir bar fails, resulting in the stir bar decoupling from the base magnet.

In addition, it is often desirable to conduct chemical reactions and/or physical reactions (e.g., distillations) under abnormal conditions, for example, under high vacuums or with highly volatile chemicals. These conditions can be adversely impacted by the components/design of the stirrer. For example, stirrer designs that have multiple joints or must be sealed would not function well in high vacuums. Similarly, electric motors would not be desirable where highly volatile chemicals are being used (e.g., where flammable or explosive materials are used).

Accordingly, it would be desirable to provide a motor-driven magnetic stirrer that can be used in high vacuum systems with highly volatile chemicals and that has a base magnet strong enough to handle highly viscous and large volumes of materials.

BRIEF DESCRIPTION OF THE DRAWINGS

Corresponding reference characters represent corresponding parts throughout the views of the drawings.

DETAILED DESCRIPTION

Figure 1:
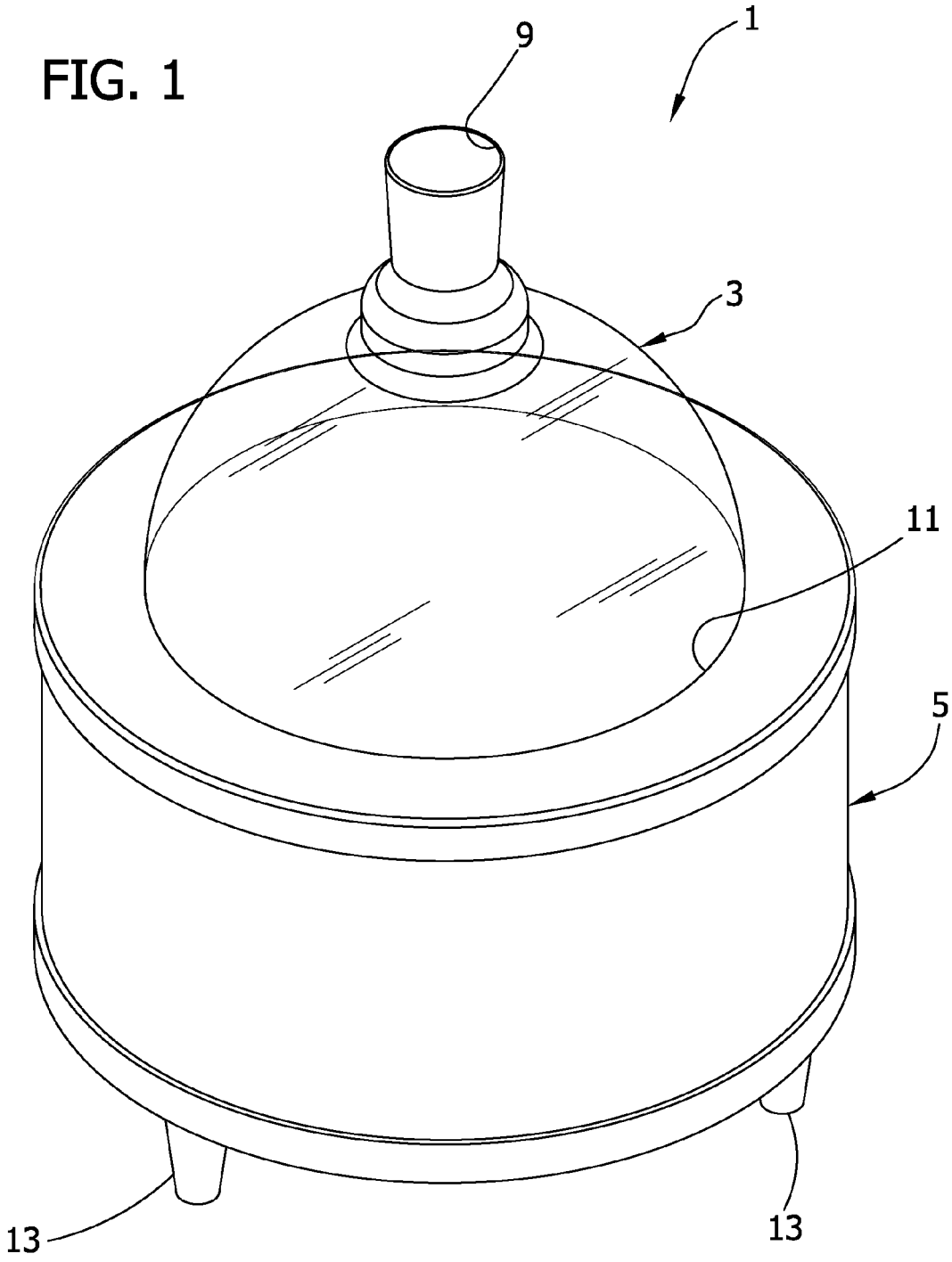
FIG. 1 is a perspective of a first embodiment of a magnetic stirring system of the invention.
Figure 2:
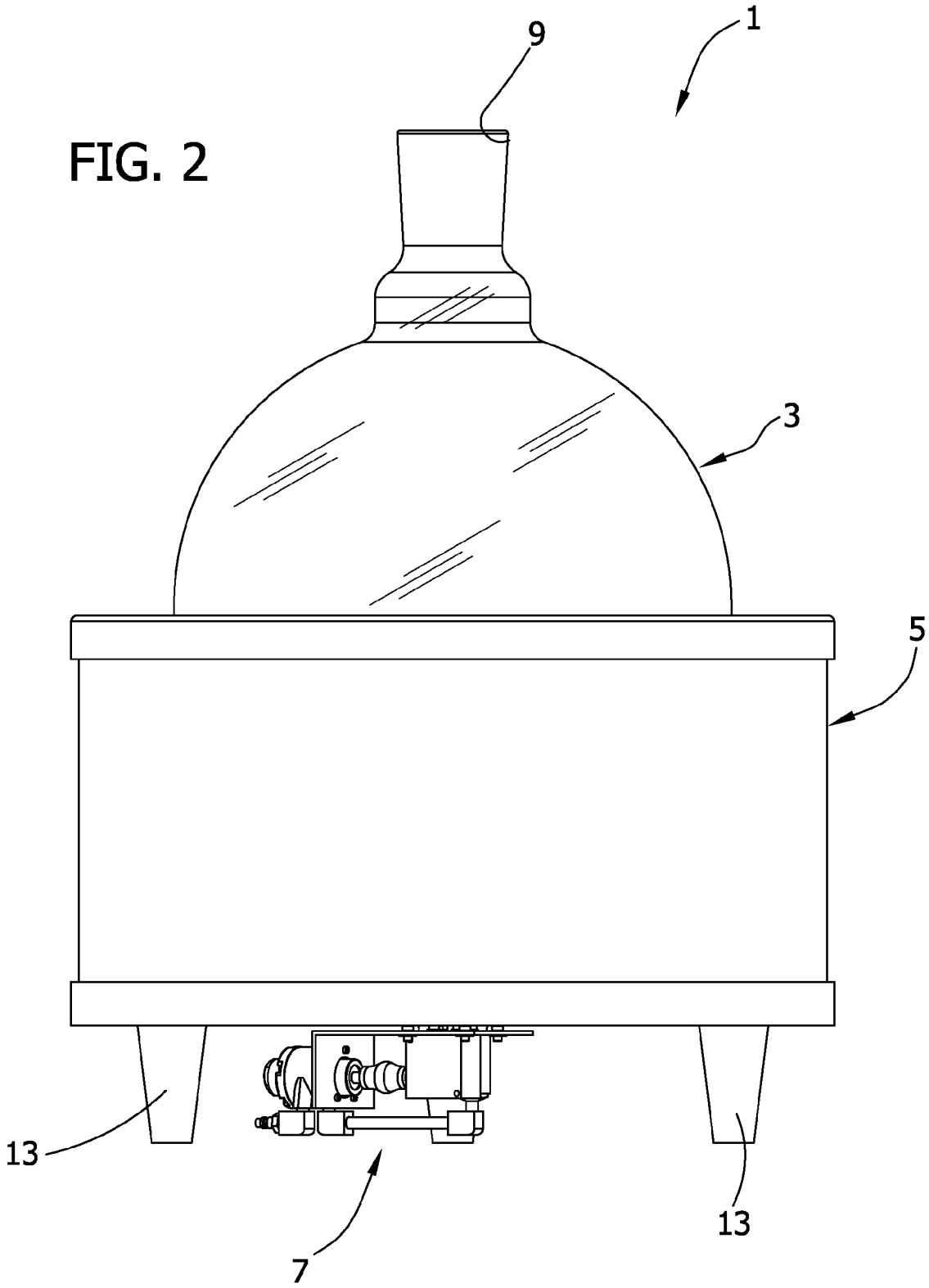
FIG. 2 is an elevation thereof illustrating a magnetic stirring apparatus mounted under a stir-mantle.

Referring now to the drawings, and particularly to FIGS. 1-4, a magnetic stirring system of the invention is shown generally at 1. The magnetic stirring system 1 generally includes a flask 3 (broadly, a "vessel"), a stir-mantle 5 shaped to support the flask within the stir-mantle, and a magnetic stirring apparatus 7 mounted to an underside of the stir mantle 5. These components are indicated generally by their reference numbers. The illustrated flask 3 is generally spherical in shape and includes a small inlet opening 9 toward its top for introducing materials (not shown, but which may include, for example, materials used in a distillation process, highly volatile materials, explosive materials, or other materials that may ignite around sparks) into the flask 3 and for substantially preventing release of materials from the flask into the environment or vice versa. Additional openings may be present in the flask 3 to attach other components not described herein that may be used in chemical reaction and/or physical reaction (e.g., distillation) operations. The flask 3 may be made of glass or other materials capable of supporting chemical reactions and/or physical reactions (e.g., distillations) within the flask 3. It may also range in size as required for the particular application, for example the flask 3 may be about a 20-liter flask, or the flask 3 may be about a 70-liter flask. The flask 3 may be larger or smaller within the scope of the invention. While a spherical flask is illustrated it is not limiting; a flask having a different shape (e.g., an Erlenmeyer flask) may be used. Moreover, a vessel other than a flask (e.g., a beaker) may be used within the scope of the invention.

The illustrated stir-mantle 5 includes a recess 11 in its top for receiving the lower portion of the flask 3, and three feet (each designated 13) at its bottom (only two feet are visible in FIGS. 1 and 2) for supporting the stir-mantle 5. While the illustrated stir-mantle 5 directly receives the flask 3, a stir-mantle may be used in which the flask is supported above the stir mantle by, for example, a support frame. In addition, a stir-mantle used with a flask or other vessel within a larger tub for safety reasons or for controlling parameters of the reactions is within the scope of the invention. Heating elements 15 (FIGS. 3 and 4) may be included within the stir-mantle 5 for providing heat to the flask 3 to facilitate chemical reactions and/or physical reactions (e.g., distillations). A stir-mantle without heating elements or with heating elements differently oriented, or a stir-mantle differently shaped is within the scope of the invention. A stir-mantle with cooling elements is also contemplated within the scope of the invention. Stirmantles are generally known in the art, and the stir-mantle 5 identified herein may be one as for example manufactured by Glas-Col, LLC of Terre Haute, Ind.

Figure 3:
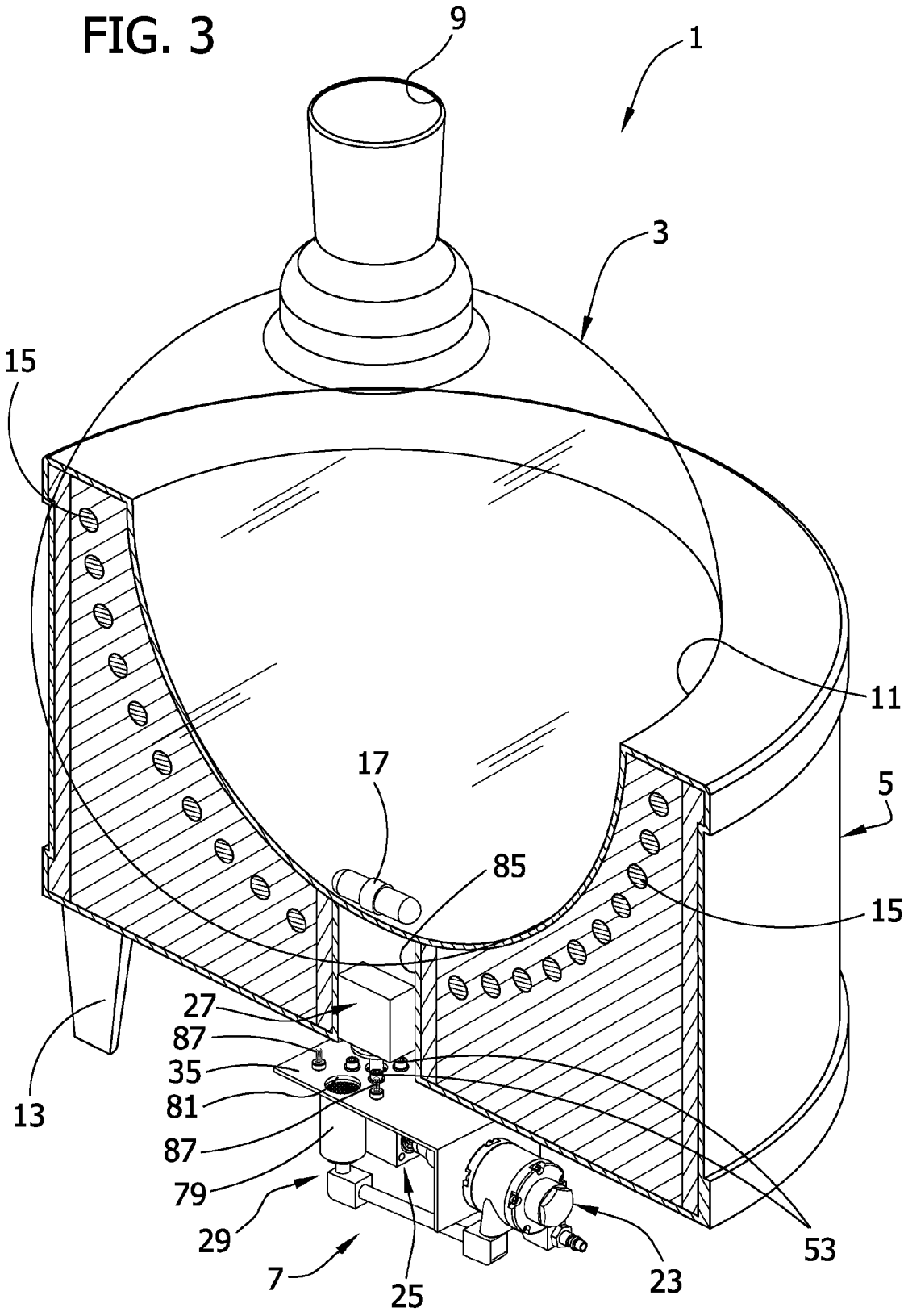
FIG. 3 is a perspective of the magnetic stirring system with part of a stir-mantle broken away to show components of the magnetic stirring apparatus.
Figure 4:
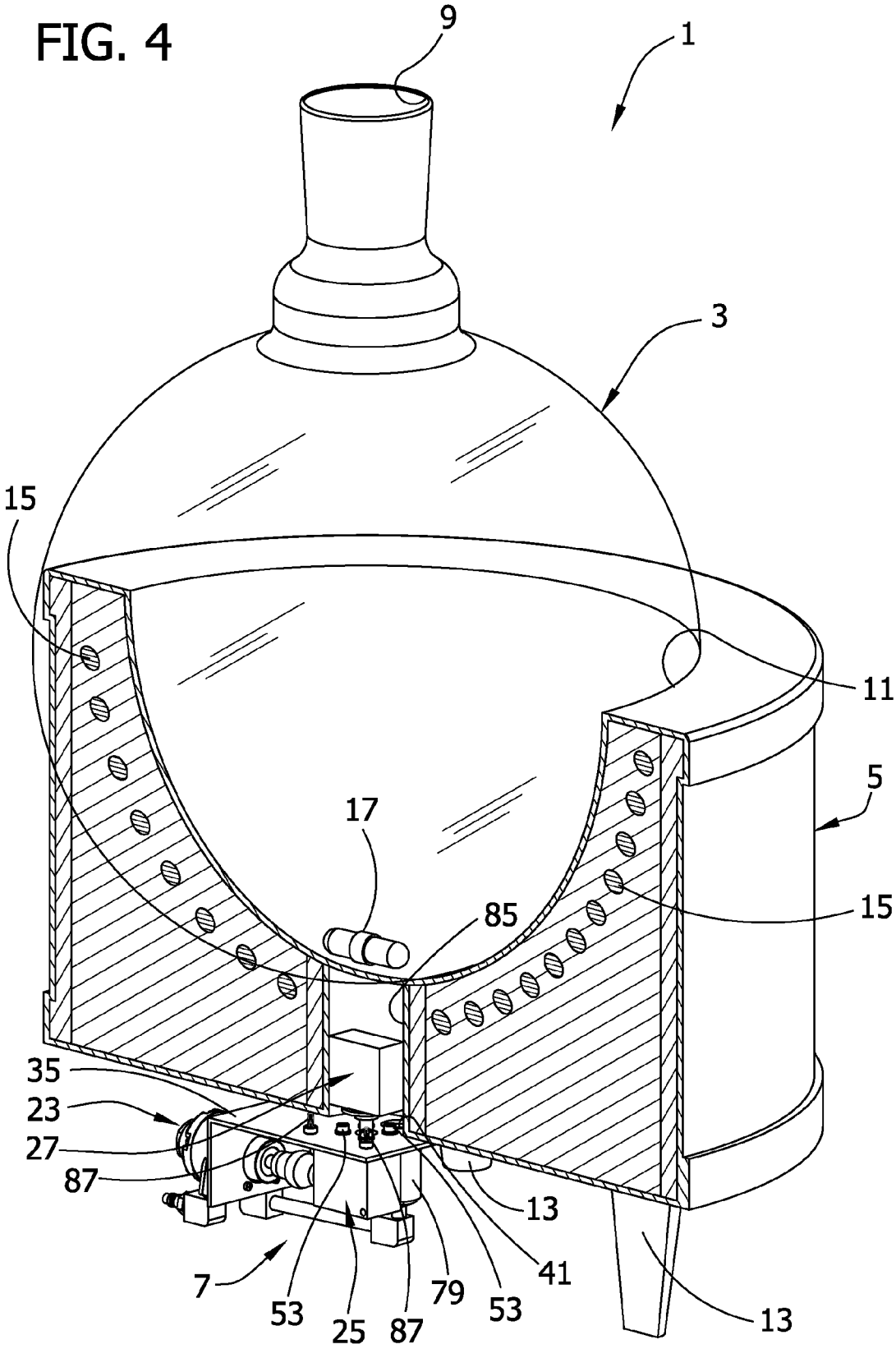
FIG. 4 is the view of FIG. 3 rotated one-hundred eighty degrees.

As best shown in FIGS. 3 and 4, a magnetic stir bar 17 (broadly "magnetic bar") is included within the flask 3 for directly stirring/mixing (broadly "moving" or "agitating") materials in the flask 3. As is known in the art, the stir bar 17 is positioned at a bottom part of the flask 3 and is rotatably driven, or spun, on the bottom surface of the flask 3 by the magnetic stirring apparatus 7 to mix the materials. This will be described in more detail hereinafter. It is to be understood that the stir bar 17 could be positioned differently in the flask for mixing materials within the scope of the invention. For example, it could be elevated above the bottom part of the flask or it could be offset from a center of the flask.

Figure 5:
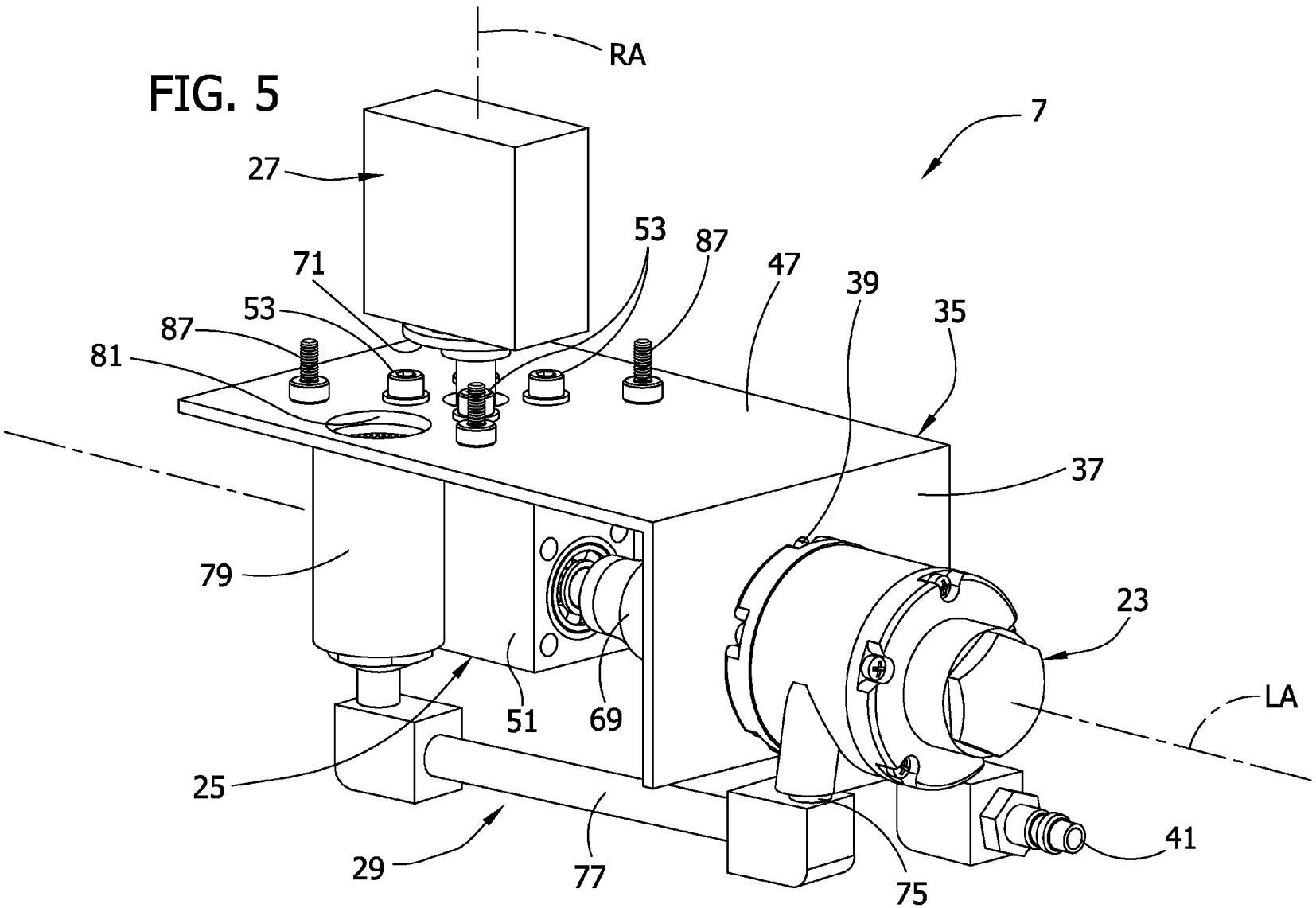
FIG. 5 is a perspective of the magnetic stirring apparatus.
Figure 7:
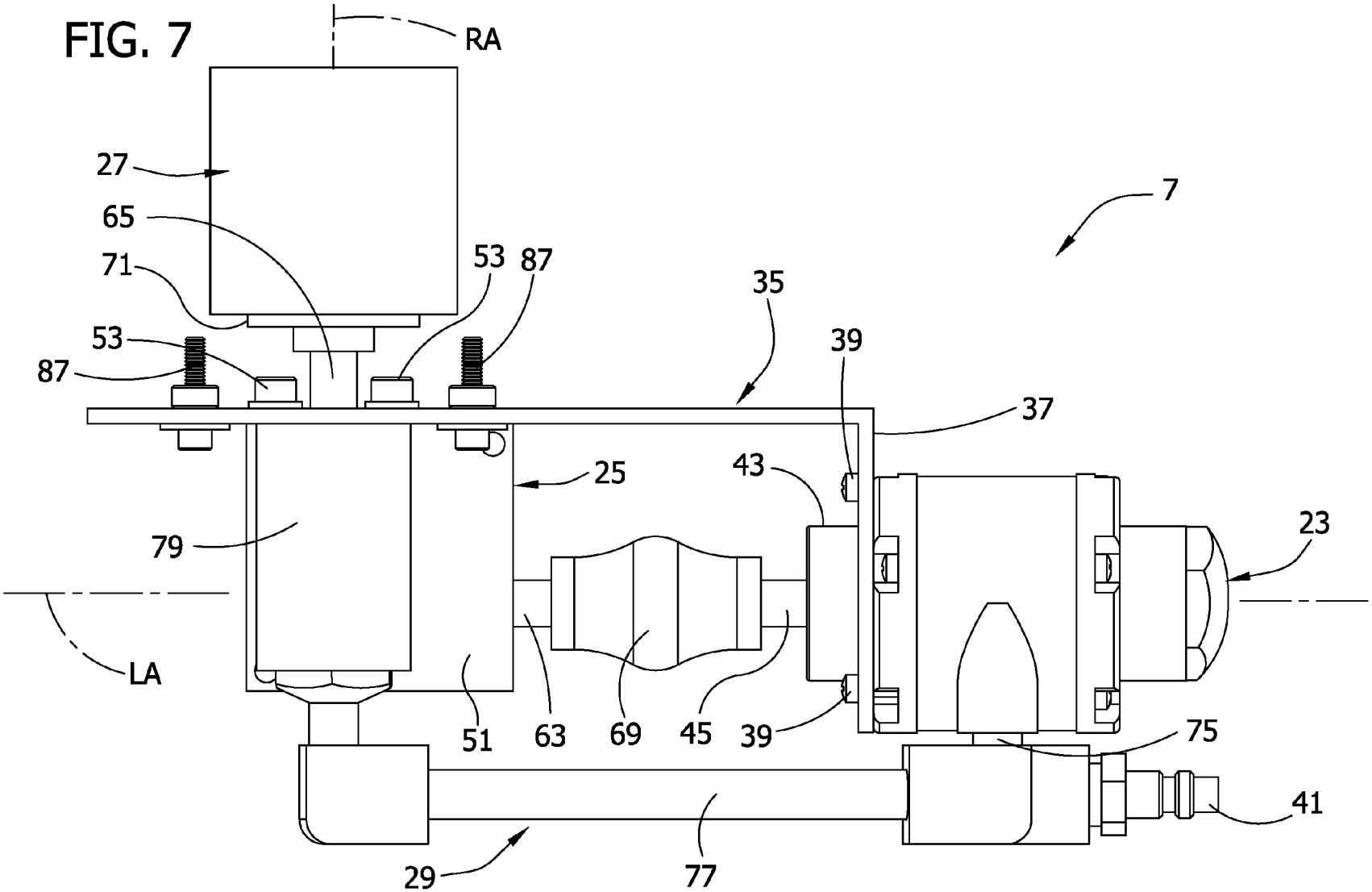
FIG. 7 is a side elevation of the magnetic stirring apparatus.

As shown in FIGS. 5 and 7, the magnetic stirring apparatus 7 generally includes a pneumatic rotary vane motor 23, a gear assembly 25 driven by the motor, a base magnet 27 (broadly, "magnetic coupler") supported by the gear assembly, and an exhaust 29. The components are each generally indicated by their reference number. Other prime movers can be used, including other types of pneumatic motors or an electric motor, within the scope of the invention.

The illustrated motor 23 is a pneumatic motor known in the art. It is mounted on a rearward end of an L-shaped bracket 35 and is generally oriented along axis LA. More specifically, the motor 23 is mounted outside of the bracket 35 on a rearward arm plate 37 of the bracket by three threaded fasteners (each indicated 39, only one fastener is visible in FIGS. 5 and 6, and only two fasteners are visible in FIG. 7). An air inlet 41 is located at a rearward end of the motor 23 for connecting the motor to a source of pressurized air (not shown). A needle valve (not shown) or other known structure may be used at the inlet 41 for controlling air flow to the motor 23. A motor bearing 43 extends forward from the mounted motor 23 through the arm plate 37 (FIG. 7), and a motor drive shaft 45 extends forward from the bearing along axis LA generally under a top plate 47 of the bracket. The bearing 43 supports the drive shaft 45 for driven rotation by the motor 23 during operation of the apparatus 7. It is to be understood that the motor 23 may be mounted differently within the scope of the invention.

Figure 6:
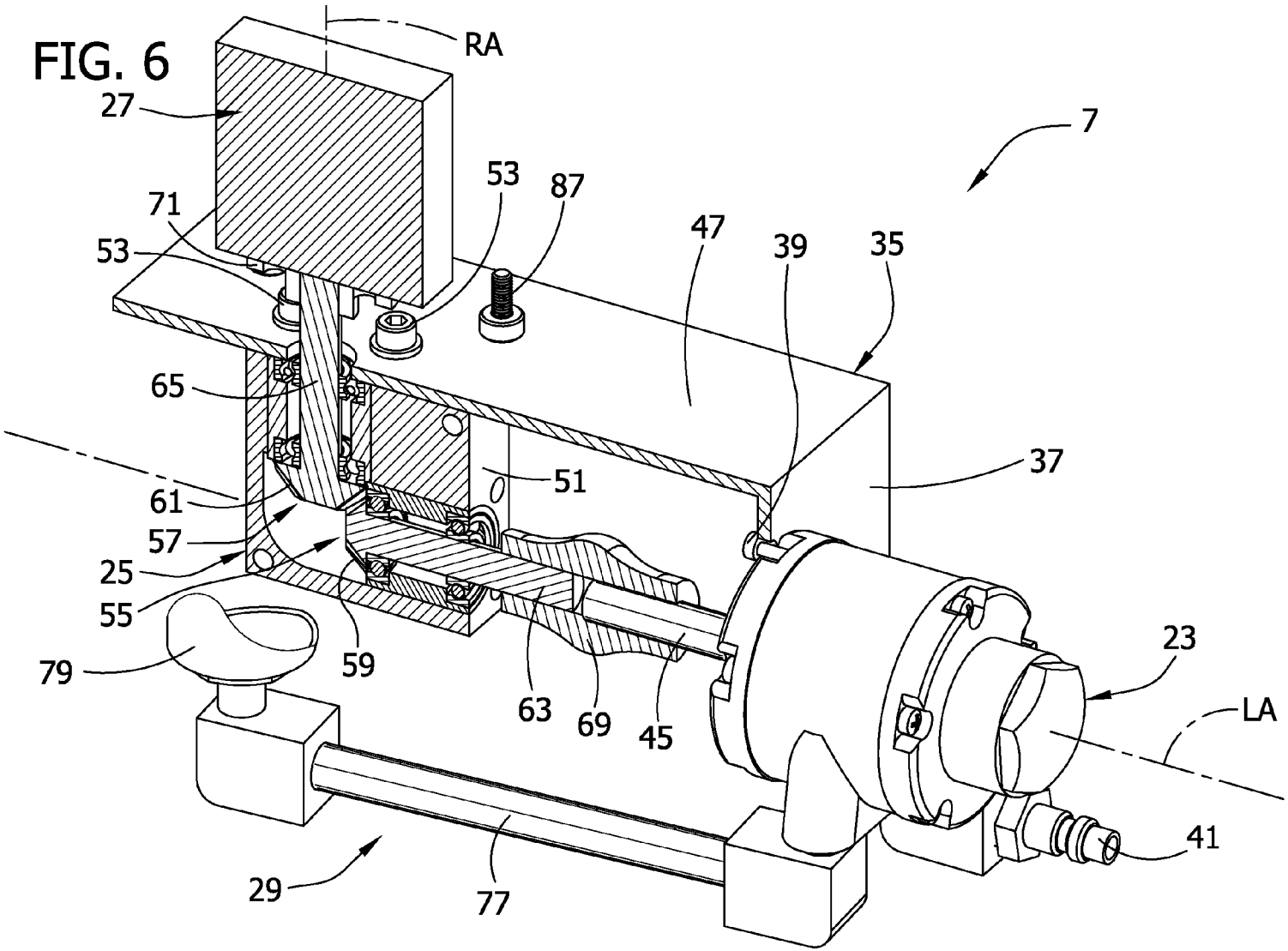
FIG. 6 is the view of FIG. 5 with part of the apparatus broken away to show internal components.

As best shown in FIGS. 6 and 7, the gear assembly 25 is located toward a forward end of the bracket 35. It is contained within a housing 51 mounted under the top plate 47 of the bracket 35 by four threaded fasteners (each indicated 53). In the illustrated embodiment, the assembly 25 is a right angle gear reduction assembly. Other gear assemblies or gear configurations may be used within the scope of the invention.

The gear assembly 25 includes an input gear, indicated generally at 55, and an output gear, indicated generally at 57. The input gear 55 and output gear 57 each have teeth 59, 61, respectively, at one end thereof (FIG. 6). The teeth 59, 61 of the two gears 55, 57 mesh so that rotation of the input gear 55 causes rotation of the output gear 57. In the illustrated embodiment, the teeth 59, 61 of the input gear 55 and output gear 57 are sized to produce a 2:1 reduction of rotational speed from the input gear to the output gear. A gear reduction assembly that provides a different reduction of rotation speed is within the scope of the invention. In addition, a gear assembly that transfers rotational speed at a 1:1 ratio, or that increases rotational speed is within the scope of the invention.

The input gear 55 and output gear 57 each have a shaft 63, 65, respectively, extending outward from the housing 51. The input shaft 63 extends outward along axis LA while the output shaft 65 extends generally outward along axis RA, substantially perpendicular to axis LA. The input shaft 63 is substantially co-linear with the motor drive shaft 45 and is operatively connected to the motor drive shaft by flexible shear coupling 69. The coupling 69 holds the input shaft 63 and the motor drive shaft 45 together for conjoint rotation. The coupling 69 is designed, however, to allow the motor drive shaft 45 to rotate relative to the input shaft 63 if the input shaft becomes locked against rotation. This may prevent the motor shaft 45 from locking against rotation and damaging the motor 23.

With reference to FIGS. 5-9, the base magnet 27 is mounted on the output shaft 65 above the top plate 47 of the bracket 35. A circular plate 71 is connected to the magnet 27 (FIG. 9) for securely receiving the output shaft 65 and for allowing the magnet 27 to conjointly rotate with the output shaft 65. The plate 71 is a metal material and is magnetically attached to the magnet 27, but may be further epoxied or otherwise attached to the magnet 27 for additional fastening strength. The magnet 27 may be oriented differently on the output shaft 65 within the scope of the invention (e.g., the plate 71 may be attached to a major surface of the magnet and mounted on the shaft 65).

In the illustrated embodiment, the base magnet 27 is a cuboid-shaped rare-earth neodymium magnet. These magnets are graded in strength from about N24 to about N54 (with a theoretical maximum strength of N64). The number after the N represents the magnetic energy product of the magnet measured in megagauss-oersteds (MGOe), where 1 megagauss-oersted is equal to 7,957 Joules per cubic meter. The illustrated neodymium magnet has a magnetic strength rating, for example, of about N40. It also has a pulling force density of, for example, about 80 pounds per cubic inch. A neodymium magnet having a strength rating smaller or larger than N40 (for example, about N50) or a pulling force density smaller or larger than 80 pounds per cubic inch (for example, about 100 pounds per cubic inch) is within the scope of the invention. Other magnets may be used within the scope of the invention, for example a different rare-earth magnet such as samarium-cobalt may be used.

Neodymium magnets, along with other rare-earth magnets such as samarium-cobalt magnets, are very strong relative to their size. The magnet 27 in the illustrated embodiment may have L×W×H dimensions (FIG. 9), for example, of about 2 inches×1 inch×2 inches. These magnets are substantially stronger than similar sized conventional magnets, such as alnico, iron or ceramic magnets, and reduce problems associated with decoupling during operation. In addition, they take up less room within a stir-mantle during operation.

Neodymium magnets are somewhat heat or temperature sensitive. As is known in the art, they may lose their magnetism at temperatures above, for example, 80 degrees Celsius. Other rare-earth magnets may be used, such as samarium-cobalt magnets, that have greater resistance to heat. Therefore, it is preferable to control the temperature of the magnet 27 during operation. To accommodate this for the neodymium magnet 27 of the illustrated embodiment, the exhaust 29 of the magnetic stirring apparatus 7 is designed to channel expended air (broadly "heat transfer fluid") from the motor 23 to the neodymium magnet 27 for circulation therearound. As shown in FIGS. 5-7, the exhaust 29 connects to the motor 23 at an air outlet 75 where spent air exits the motor 23 and enters the exhaust 29. Exhaust piping 77 channels the spent air from the motor 23 to an exhaust muffler 79 which reduces noise from the motor 23 and directs the air toward the magnet 27. In the illustrated embodiments, the exhaust piping 77 and/or the exhaust muffler 79 may be broadly considered an "exhaust conduit." The muffler 79 is located adjacent the gear assembly 25 and mounts under the top plate 47 of the mounting bracket 35 at an exhaust opening, or vent, 81. The exhaust opening 81 is generally below the magnet 27 allowing air channeled through the exhaust 29 to exit the opening 81 and flow around the magnet 27. This ultimately maintains the air temperature around the magnet 27 at an acceptable level and keeps the magnet cool. The illustrated muffler 79 is a standard muffler provided with the motor 23 and is, for example, manufactured by Gast Manufacturing, Inc. of Benton Harbor, Mich. A different muffler may be used within the scope of the invention.

Figure 8:
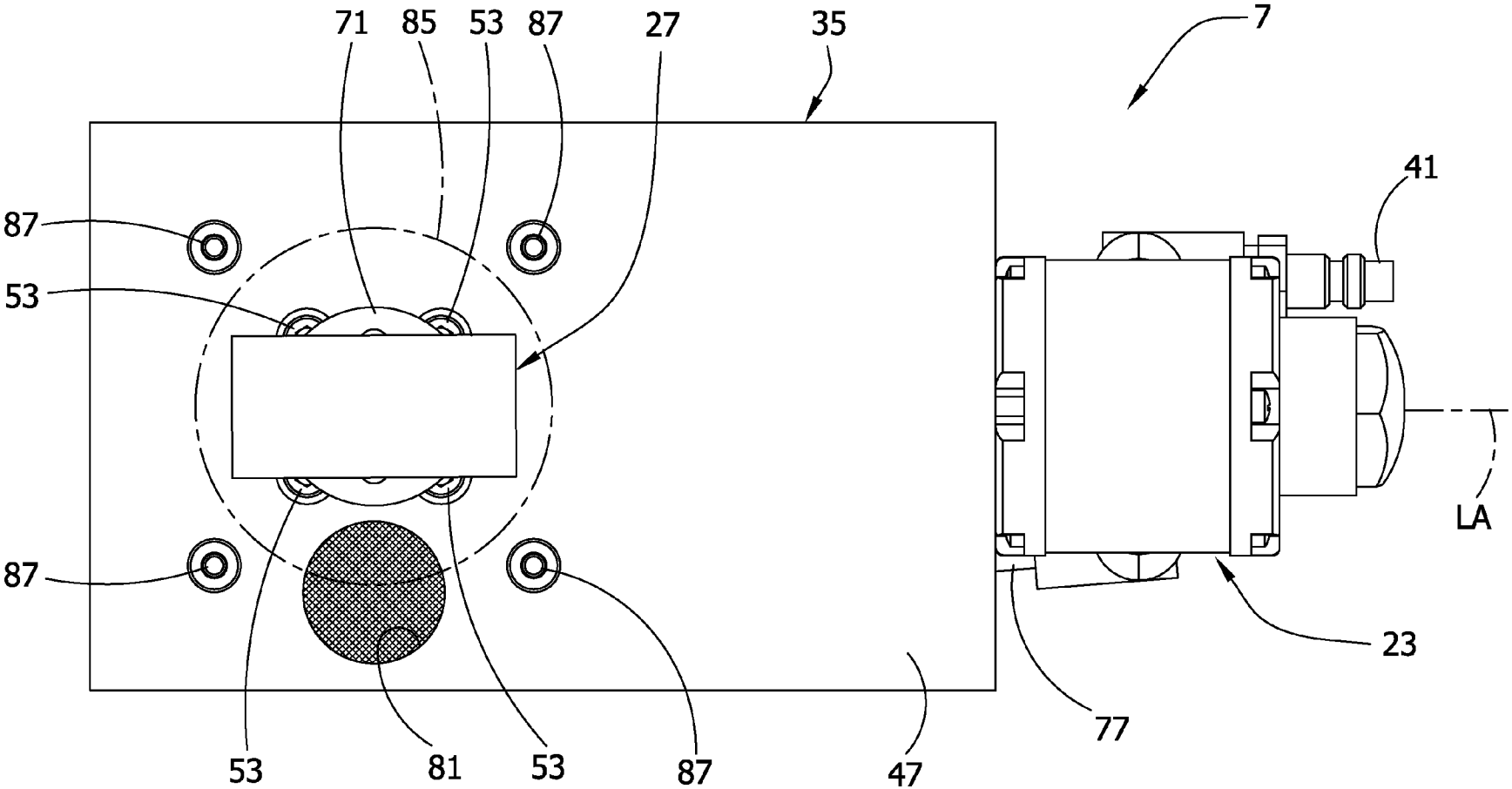
FIG. 8 is a top plan view of the magnetic stirring apparatus shown in relation to a shroud of the stir-mantle where the shroud is illustrated by broken lines.
Figure 9:
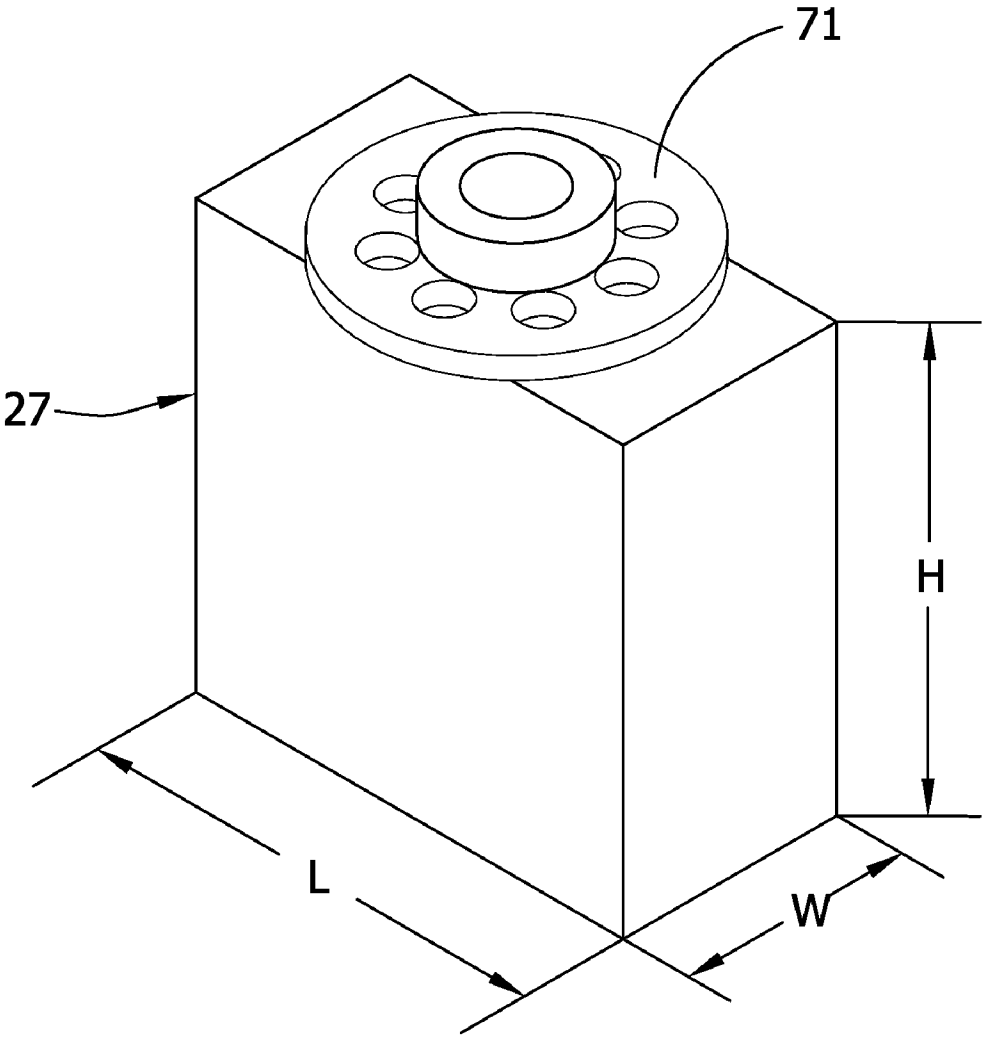
FIG. 9 is a perspective of a magnet of the magnetic stirring apparatus.

With reference to FIGS. 3, 4, and 8, the magnetic stirring system 1 is shown with the magnetic stirring apparatus 7 mounted generally under a center of the stir-mantle 5 and with the magnet 27 positioned in a tubular shroud 85 in the stir-mantle 5. Exhaust opening 81 is arranged to direct a flow of cooling air into the shroud 85. The apparatus 7 may be mounted off-center under the stir-mantle 5 within the scope of the invention. In FIG. 8, the shroud 85 is illustrated in phantom to give a perspective of the location of the magnet 27 and exhaust opening 81 relative to the shroud 85. The magnet 27 is positioned in the shroud 85 for magnetically coupling with the stir bar 17. In the illustrated embodiment, the magnet 27 is spaced apart from the stir bar 17 with a portion of stir-mantle 5 and flask 3 extending between the magnet 27 and the stir bar 17 located in the flask. But it is understood that a stir-mantle may be used in which no part of the mantle extends between the base magnet 27 and the stir bar 17. In addition, the base magnet 27 may be positioned closer to the flask, or even contacting the flask, within the scope of the invention. Four threaded connectors (each indicated at 87) hold the apparatus 7 under the stir-mantle 5 with the magnet 27 and exhaust opening 81 within the shroud 85.

Briefly, operation of the illustrated magnetic stirring apparatus 7 is as follows. Air enters the air motor 23 through the air inlet 41 under control of the needle valve. The air activates the motor 23 and drives rotation of the motor drive shaft 45 about axis LA. The drive shaft 45 jointly turns the input shaft 63 and input gear 55 of the gear assembly 25, which in turn drives the output gear 57 and its shaft 65, at a reduced rotational speed. The output shaft 65 rotates the neodymium magnet 27 about axis RA within the shroud 85 and causes the stir bar 17 in the flask 3 to rotate on the bottom part of the flask 3, mixing the material inside the flask 3. The heating elements 15 may be activated on the stir-mantle 5 to provide heat energy to the materials within the flask 3 to promote desired chemical reactions and/or physical reactions (e.g., distillations).

As compressed air is spent through the motor 23, it expands and is channeled through the exhaust 29 to the exhaust opening 81. The opening allows air to flow into the shroud 85 where it circulates around the neodymium magnet 27 and exits the shroud 85, keeping the air around the magnet cooler and preventing the magnet 27 from overheating. The cooling operation of the exhaust air is particularly important when the heating elements 15 of the stir-mantle 5 are in use because the heating elements 15 not only heat the reaction materials within the flask 3, but also the magnet 27 within the shroud 85. It should be understood that the mounting bracket 35 is secured to the stir-mantle 5 so that excess air can escape the shroud 85 through intentionally left space gaps between the mounting bracket 35 and the underside of the stir-mantle 5. In this way, fresh, cool air from the exhaust 29 constantly circulates around the magnet 27 to keep it cool. In the illustrated embodiment, the exhaust opening 81 or the entire exhaust may be broadly considered a "cooling system." It is to be understood that other types of cooling systems may be used without departing from the scope of the present invention. For example, the cooling system may include air from the supply of air driving the motor 23 for cooling the magnet, either as a primary source of cooling air or in combination with spent air from the motor. Also for example, the cooling system may be a fan positioned to blow ambient air through the shroud 85, a heat sink connected to the magnet 27, or other device in thermal communication with the magnet. It will be appreciated that other cooling systems that could be used would not require use of a pneumatic motor to achieve cooling of the magnet.

However, it can be seen that using a pneumatic motor instead of an electric motor to operate a base magnet in a magnetic stirring system allows for operation of the system in an environment comprising flammable materials. In addition, using a magnetic stirrer allows for effective mixing operation in flasks with small inlet openings used to prevent escape of materials to the surrounding environment or vice versa. Furthermore, using a neodymium magnet offers improved mixing strength for the larger vessels contemplated in the magnetic stirring system disclosed herein.

In the illustrated embodiment, the magnet 27 is supported by the gear assembly 25, which is mounted under the bracket 35, which in turn is mounted on an underside of the stir-mantle 5. Either the bracket 35 or the stir-mantle 5 can be broadly interpreted as a "frame" supporting the magnet 27. But it is to be understood that the magnet 27 could be supported by a frame that is other than a bracket or a stir-mantle, or that it could be supported by a stir-mantle using structure other than a bracket within the scope of the invention.

In the illustrated embodiment, the motor 23 is also mounted on the bracket 35, which in turn is mounted on the stir-mantle 5. The motor 23 may be mounted on the stir-mantle by structure other than a bracket. Or the motor 23 may not be mounted on the stir-mantle 5 at all (e.g., a flexible drive shaft could be used with a remote-mounted motor) within the scope of the invention.

Figure 10:
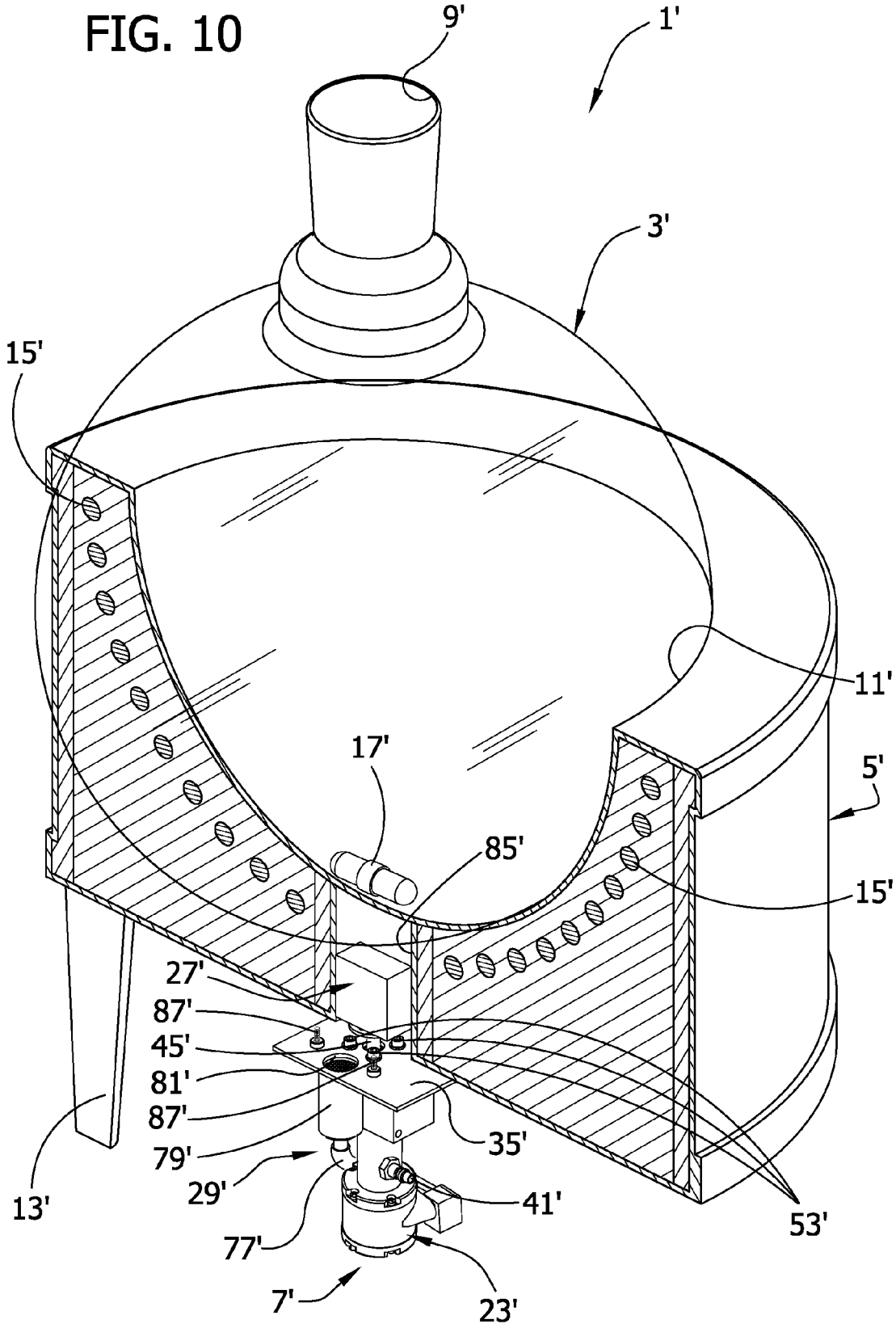
FIG. 10 is a perspective of another embodiment of the magnetic stirring system with part of a stir mantle broken away to show components of the magnetic stirring apparatus.

Another embodiment of the magnetic stirring system 1' is shown in FIG. 10. Parts of the magnetic stirring system 1' of this embodiment corresponding to those of the magnetic stirring system 1' of the first embodiment are given the same reference numerals with the addition of a following "prime". The stir-mantle 5' substantially the same as the stir-mantle 5 of the first embodiment, but the magnetic stirring apparatus 7' differs from the magnetic stirring apparatus 7, as will be described. In short, the pneumatic rotary vane motor 23' has been replaced by a pneumatic radial piston motor 23'. The radial piston motor 23' operates at a lower speed than the rotary vane motor 23' so that the gear assembly 25 of the first embodiment is eliminated. The motor 23' is mounted on a bracket 35' and is generally oriented vertically to directly drive the magnet 27' via the drive shaft 45'. Accordingly, with regard to the mounting of the base magnet 27' in this embodiment, the drive shaft 45' functions substantially identically to the output shaft 65 of the first embodiment. The magnet 27' and supporting structure can be the same as the magnet 27 and supporting structure of the first embodiment. The motor 23' is mounted by the bracket 35' (which is a flat plate in this embodiment) to the stir-mantle 5' using fasteners 53', 87'. Because of the vertical orientation of the motor 23', this embodiment requires longer stir mantle feet 13' to sufficiently elevate the stir mantle 5' to allow space for the motor 23'. Other components of the magnetic stirring apparatus 7' of this embodiment, such as the air inlet 41', exhaust piping 77' and exhaust muffler 79' are substantially the same as the corresponding parts of the first embodiment.

The term "stirring" is used in the identifying names of the magnetic stirring system 1, 1' and the magnetic stirring apparatus 7, 7' described herein. However, the term is not intended to limit the scope of the system 1, 1' or apparatus 7, 7' in any way and should not be interpreted as a limiting feature. Stirring, mixing, moving, or agitating materials within a vessel, or any combination thereof, is contemplated within the scope of the invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A magnetic stirring apparatus for moving a magnetic bar in a vessel to mix material in the vessel, the magnetic stirring apparatus comprising:

a frame;

a magnet supported by the frame and adapted to be magnetically coupled to the bar when the vessel is proximate to the magnet so that movement of the magnet causes movement of the bar;

a cooling system in heat transfer communication with the magnet for removing heat from the magnet;

a motor operatively connected to the magnet for producing said movement of the magnet, the motor comprising a pneumatic motor, the cooling system comprising an exhaust from the pneumatic motor that directs air from the motor to the magnet for cooling the magnet.

2. A magnetic stirring apparatus as set forth in claim 1 wherein the exhaust comprises a vent adjacent the magnet, the vent directing air to the magnet.

3. A magnetic stirring apparatus as set forth in claim 2 wherein the exhaust comprises an exhaust conduit, the exhaust conduit connecting the vent to the motor for carrying air from the motor to the vent.

4. A magnetic stirring apparatus as set forth in claim 1, wherein the magnet is a neodymium magnet.

5. A magnetic stirring apparatus as set forth in claim 4, wherein the neodymium magnet has a strength rating of about N40 or greater.

6. A magnetic stirring apparatus as set forth in claim 5, wherein the neodymium magnet has a strength rating of about N50 or greater.

7. A magnetic stirring apparatus as set forth in claim 1, wherein said magnet has a pulling force density of at least about 80 pounds per cubic inch.

8. A magnetic stirring apparatus as set forth in claim 7, wherein said magnet has a pulling force density of at least about 100 pounds per cubic inch.

9. A magnetic stirring apparatus as set forth in claim 1, wherein said exhaust comprises a muffler operable to reduce noise associated with operation of the pneumatic motor.

10. A magnetic stirring system comprising a magnetic stirring apparatus as set forth in claim 1 in combination with said vessel and said magnetic bar.

11. A magnetic stirring system as set forth in claim 10 wherein the magnetic bar is a stir bar and a portion of the vessel extends between the magnet and the stir bar and forms a barrier therebetween.

12. A magnetic stirring system as set forth in claim 11 wherein the magnetic stirring system is operable to substantially prevent release of materials from the vessel into the environment or vice versa.

13. A magnetic stirring system as set forth in claim 10 wherein the vessel has a capacity of at least about 20 liters.

14. A magnetic stirring system as set forth in claim 13 wherein the vessel has a capacity of at least about 70 liters.

15. A magnetic stirring system as set forth in claim 1 further comprising a heating element operable to heat a material contained in the vessel.

16. A magnetic stirring system as set forth in claim 15 wherein the frame comprises a stir-mantle for supporting the vessel, the stir-mantle containing the heating element for heating said material contained in the vessel while it is supported by the stir-mantle.

17. A magnetic stirring apparatus as set forth in claim 1 wherein the magnet is susceptible to a reduction in magnetic strength at temperatures above approximately 80 degrees Celsius.

18. A magnetic stirring apparatus for moving a magnetic bar in a vessel to mix material in the vessel, the magnetic stirring apparatus comprising:

a magnetic coupler comprising at least one magnet, the magnetic coupler being configured to permit magnetic coupling of the magnetic coupler with the magnetic bar in the vessel so that rotation of the magnetic coupler results in rotation of the magnetic bar for stirring a material contained in the vessel;

a pneumatic motor operable to expand a compressed gas in a manner that drives rotation of the magnetic coupler and results in an expanded gas exhaust; and an exhaust conduit having an exhaust opening positioned with respect to the magnet for directing the expanded gas exhaust from the pneumatic motor to the magnet for cooling the magnet.

* * * * *